73-151 SR
1/13/87 XR 4,635,717

United States Patent [19]
Jageler

[11] Patent Number: 4,635,717
[45] **Date of Patent: * Jan. 13, 1987**

[54] METHOD AND APPARATUS FOR OBTAINING SELECTED SAMPLES OF FORMATION FLUIDS

[75] Inventor: Alfred H. Jageler, Tulsa, Okla.

[73] Assignee: Amoco Corporation, Chicago, Ill.

[ * ] Notice: The portion of the term of this patent subsequent to Aug. 20, 2002 has been disclaimed.

[21] Appl. No.: 732,523

[22] Filed: May 9, 1985

Related U.S. Application Data

[63] Continuation of Ser. No. 618,613, Jun. 8, 1984, Pat. No. 4,535,843, which is a continuation of Ser. No. 380,689, May 21, 1982, abandoned.

[51] Int. Cl.[4] ..... E21B 49/08
[52] U.S. Cl. ..... 166/250; 166/264; 166/65.1; 166/187; 166/191; 73/151
[58] Field of Search ..... 166/250, 264, 65.4, 166/66.4, 66, 147, 169, 113, 191; 73/152, 154, 153, 155; 324/354, 357, 376, 324, 351

[56] References Cited

U.S. PATENT DOCUMENTS

| | | | |
|---|---|---|---|
| 2,441,894 | 5/1948 | Mennecier | 166/63 |
| 2,564,198 | 8/1951 | Elkins | 73/155 |
| 2,607,222 | 8/1952 | Lane | 73/155 |
| 2,831,541 | 4/1958 | Conover | 166/147 |
| 2,922,103 | 1/1960 | Smith | 324/324 |
| 2,942,462 | 6/1960 | Buck | 73/152 |
| 3,294,170 | 12/1966 | Warren et al. | 166/100 |
| 3,577,783 | 5/1971 | Whitten et al. | 73/152 |
| 3,611,799 | 10/1971 | Davis | 73/155 |
| 3,677,081 | 7/1972 | Newton et al. | 73/155 |
| 4,230,180 | 10/1980 | Patton et al. | 166/264 X |
| 4,254,832 | 3/1981 | Patton et al. | 166/332 |

*Primary Examiner*—Stephen J. Novosad
*Assistant Examiner*—Michael A. Goodwin
*Attorney, Agent, or Firm*—Scott H. Brown; Fred E. Hook

[57] ABSTRACT

A method and apparatus operable on a wireline logging cable for sampling and testing bore hole fluids, transmitting the results obtained from such testing to the surface for determination whether or not the particular sample undergoing testing should be collected and brought to the surface. The apparatus comprises a downhole tool having an inflatable double packer for isolating an interval of the bore hole coupled with a hydraulic pump, the pump being utilized sequentially to inflate the double packer and isolate an interval of the bore hole and to remove fluids from the isolated interval to test chamber means where resistivity, redox potential (Eh) and acidity (pH) are determined, and finally to dispose of selected samples to one or more sample container chambers within said tool or to reject them into the bore hole if not selected.

13 Claims, 4 Drawing Figures

FIG.1
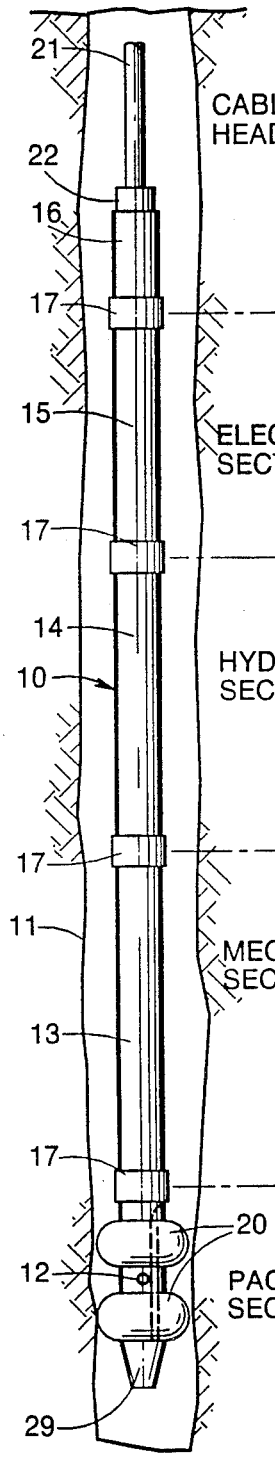
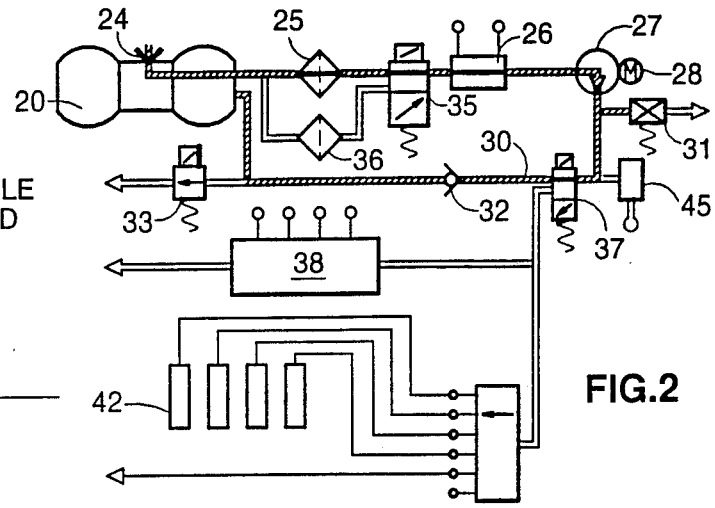
FIG.2
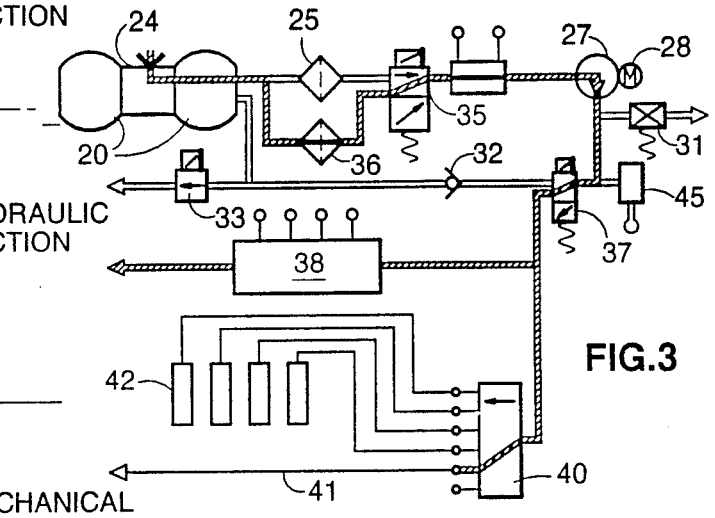
FIG.3
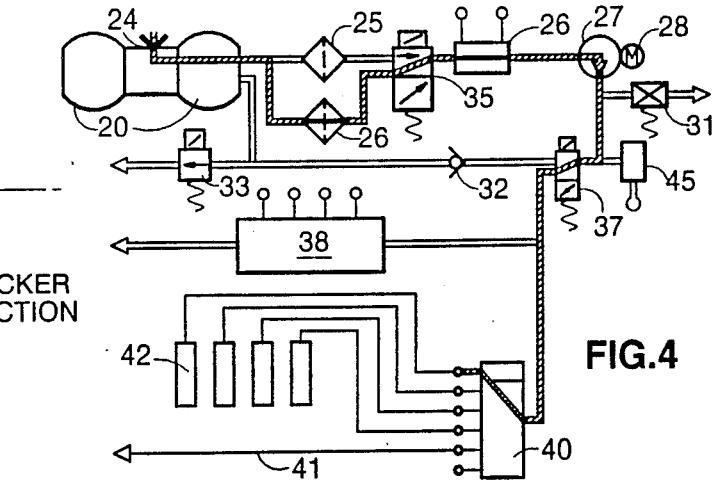
FIG.4

METHOD AND APPARATUS FOR OBTAINING SELECTED SAMPLES OF FORMATION FLUIDS

This is a continuation of co-pending application Ser. No. 618,613, filed 6/8/84, now U.S. Pat. No. 4,535,843, which is a continuation of Ser. No. 380,689, filed 5/21/82, now abandoned.

BACKGROUND

1. Field of the Invention

This invention relates to a method and apparatus for obtaining samples of formation fluids at different levels in a bore hole. The characteristics of formation fluids obtained from various levels within a bore hole are of considerable interest to geologists as an aid to determining subsurface structure as well as to those engaged in well completion and production. This invention provides a method and apparatus for lowering a logging tool into an uncased bore hole on a conventional wireline, positioning the tool at preselected elevations and obtaining formation fluid samples. The samples are tested within the tool without withdrawing it from the bore hole and the test results transmitted to the surface. If it is determined that the sample should be recovered it is transferred to one of a plurality of collection chambers within the tool, and, if not, it is ejected into the bore hole. The logging tool can then be moved to another level, without withdrawal from the well and the process repeated until all of the sample collection chambers in the tool are filled.

2. Description of the Prior Art

Formation fluid sample collection tools have been in use in the industry for a number of years. See for example the descriptive matter found in the Composite Catalog of Oil Field Equipment and Services—1978–1979, pages 3286–3291 for a description of services and equipment provided by Halliburton Services. See also in the 1976–1977 edition of the same catalog the description of the Johnson Inflatable Packer Test Systems at pages 3607–3609. Both the Halliburton and Johnson systems involve attaching the sampling tool to the drill pipe string and are not designed for wireline logging. Moreover, they do not have means for isolating and testing formation fluids at various selected levels within the bore hole to make a determination as to the desirability of collecting and retaining the sample without withdrawal of the tool from the well. These two differences are of considerable significance when the time the well must be out of commission for sampling is taken into consideration. To run a tool into a well on a wireline requires but a small fraction of the time required to run in a drill pipe string and the advantage of being able to collect a number of pretested samples each time the tool is sent down the well further greatly reduces the time during which the well is out of commission.

Wireline formation testers have been available since the early 1950's and have been used to obtain fluids, flow rates and pressures from prospective reservoirs. Because of limited tool capacity and capabilities, however, recovered fluids often are entirely or mostly drilling mud filtrate. Moreover, there is no fluid property monitoring capability. Thus these tools are useful only in the case of reservoirs where adequate flow is obtained and recovered fluids are relatively free of mud filtrate. They tend not to be useful in those cases where geological exploration is involved and fluid samples other than those containing hydrocarbon are desired.

SUMMARY OF THE INVENTION

A primary object of this invention is to provide a method for obtaining a plurality of high quality samples of formation fluids from the wall of a bore hole on a single passage of a logging tool into the bore hole by locating the tool at various levels within the bore hole, isolating an interval of the bore hole, withdrawing fluid from the isolated interval, testing the properties of the withdrawn fluid while within the tool, transmitting the test results to the surface for determination of the suitability of the sample for collection and, if it is found suitable, transferring the sample to a collection chamber within the tool for ultimate removal to the surface.

A second and related object of this invention is to provide a logging and sample collecting tool operable in connection with a conventional wireline for carrying out the method of this invention.

This invention is directed to an improved method and apparatus for obtaining formation fluid samples from a bore hole. The method involves initially lowering a tool suspended by a wireline into the bore hole to a preselected level; and utilizing a pair of packers carried by the tool to isolate an interval of the bore hole by inflating the packers to expand them into sealing contact with said bore hole. Fluid is withdrawn from the isolated interval between the packers and its electrical resistivity is measured in a resistivity test chamber located within the tool. The resistivity measurement is sent to the surface via the wireline and when the resistivity becomes constant, indicating that formation fluids uncontaminated by drilling mud components are being withdrawn into the tool, the withdrawn fluids are directed into a second test chamber wherein the redox potential (Eh), acidity (pH) and temperature of the fluids are measured and the results are sent to the surface by the wireline. It is then determined from the thus transmitted results whether it is desired to retain a sample and, if determination is positive, the fluid is pumped to one of a plurality of sample collection chambers within said tool. If the determination is negative, the fluid is returned to the bore hole, the packers are deflated to free the tool for vertical movement and the tool is moved to another preselected location; where the above-referred to steps are repeated. This procedure is followed until the sample chambers in the tool are filled with desired samples, and finally the wireline is retracted to return the tool and the contained samples to the surface.

A preferred embodiment of the apparatus of this invention comprises a tool adapted to be introduced into a bore hole on a conventional seven conductor wireline and having a pair of spaced apart inflatable packers for isolating an interval of the bore hole. A hydraulic pump is provided within the tool for pumping fluids from the interval between the packers, initially for inflating the packers, and subsequent to their inflation for pumping fluids through a resistivity test chamber and a second test chamber where redox potential (Eh), acidity (pH) and temperature measurements are obtained, and finally into one or more sample collection chambers located within the tool. Conventional means are associated with each of the chambers for performing the above-described measurement and for transmission of the results thereof to the surface through the wireline. In addition, there are provided suitable valve means electrically controlled from the surface for sequentially carrying out the method steps of this invention.

BRIEF DESCRIPTION OF THE DRAWING

FIG. 1 is a side view of a preferred embodiment of a logging tool of this invention disposed within a section of a bore hole;

FIG. 2 is a schematic view showing the relationship of the various elements of the tool of this invention during the packer inflation step;

FIG. 3 is a similar view showing the relationship of the elements during the testing step; and FIG. 4 is a similar view showing the relationship during the sample collection step.

DETAILED DESCRIPTION OF THE INVENTION

In FIG. 1 a preferred embodiment of the tool 10 of this invention is shown in a downhole position in a bore hole 11. In this embodiment the tool is made up in tubular sections 12 through 16 which are connected in sealed relationship by collars 17. During movement through the bore hole and when the packers 20 are not set, the tool 10 is suspended from the cable head section 16 to which the supporting wireline 21 is securely attached by coupling 22. The use of individual section 12–16 each containing certain kinds of components is, of course, optional but it provides a convenient way to manufacture, assemble and service the tool 10. The maximum diameter of the tool 10 is, of course, limited by the size of the bore hole 11 and the effectiveness of the expandable packers 20. A convenient arrangement is to make the sections 13–16 of somewhat smaller diameter so that these portions of the tool can be utilized in smaller bore holes and to utilize a packer section 12 appropriately sized to perform adequate sealing in a particular bore hole to be tested and sampled. The following Table gives preferred packer sizes for different bore hole diameters:

TABLE

| Minimum Bore Hole Diameter In Inches | Packer Size in Inches | Packer Expansion Capacity in Inches |
|---|---|---|
| 6.25 | 5.00 | 9.00 |
| 7.88 | 6.25 | 11.25 |
| 8.75 | 7.25 | 13.00 |

From the foregoing it will be seen that, for a versatile tool, the maximum diameter of the sections 13–16 is about five inches. The length of a tool of five-inch diameter will depend upon the degree of miniaturization in hydraulic and electric circuitry and in the size and number of samples which are to be collected. Usually the lenght is between 6 and 12 feet.

In FIGS. 2–4 the hydraulic relationship of the various parts of the tool 10 during various steps of the preferred method are shown. In each of these Figures the main fluid flow for the particular step involved is indicated by a heavy line.

In FIG. 2 the step of inflating the packers is illustrated. Fluid from the bore hole 11 is withdrawn into the tool 10 through an open port 24 in packer section 12 passing through a filter 25 and resistivity test chamber 26. This test chamber which is preferably conventional can contain a pair of spaced apart electrodes across which a voltage is impressed. The resulting current flow between the electrodes provides an indication of resistivity. Suction for withdrawing the fluid is provided by a pump 27 driven by an electric motor 28 powered from the surface by an electric current delivered through the wireline 21. From pump 27 the withdrawn fluid passes through conduit 30 to the packers 20 which are inflated thereby to engage the wall of the wellbore in sealing relationship and isolate an interval thereof. To prevent the development of a pressure differential in the bore hole 11 above and below the tool 10 when the packers 20 are inflated, a passage 29 is provided through the packer section 12 as shown in FIG. 1. A pressure relief valve shown at 31 vents fluid to the bore hole when the packers 20 are filled. A back flow check valve 32 prevents fluid from flowing back out of the packers 20 when pump 27 is not operating. An electrically controlled packer deflate valve 33 is provided for venting conduit 30 to the wellbore when it is desired to deflate the packers 20.

Following inflation of the packers 20 the pump 27 continues to pump fluid from the bore hole through the resistivity test chamber venting the fluid to the bore hole through valve 31. This action is preferably continued until the resistivity measurement, which is conveyed to the surface through the wireline 21, becomes constant indicating that formation fluids free of drilling mud components are being withdrawn. At such time the pump 27 is stopped and the various valves are set to provide the flow pattern shown in FIG. 3.

To better illustrate the invention the various flow controlling valves have been schematically indicated. A preferred procedure, as will be appreciated by those familiar with the art, is to use a pair of rotary solenoid actuated valves (not shown) which are positioned by pulses sent down from the surface. Preferably, one of these rotary solenoid valves, as will be described later, is employed to control the pumping of samples to the sample containers and the other is preferably employed to control all of the other fluid flows.

After the packers 20 have been set and the resistivity cell 26 indicates that a uniform formation fluid is being withdrawn, the flow control valve (not shown) is rotated to place the schematically indicated valve elements in the positions shown in FIG. 3. Thus the filter control valve element 35 is actuated to cause the fluid to flow through line filter 36 instead of the large coarse filter 25 improving the quality of the withdrawn sample and the control valve 37 is actuated to divert the fluid flow through the second test chamber 38 to the bore hole 11.

The second test chamber 38 preferably contains a three electrode system for measuring acidity (pH) and redox potential (Eh). A temperaure sensor (not shown) is also provided as the temperature at which potential readings are made affects calibration. The preferred electrodes are as follows:

pH Reference—silver

Eh Reference—platinum

Reference electrode-antimony but as will be appreciated any of the well known arrangements can be utilized. Moreover, in certain cases it may be desirable to adapt the test chamber 38 to perform other or additional kinds of tests such as retractive index, opacity, density of dissolved gas content all of which are known to those familiar with the art. Conventional electrical circuits are utilized to send appropriate signals through the wireline to the surface where pH, Eh and temperature of the formation fluid can be displayed or read out. It should be noted in FIG. 3 that a portion of the fluid does not pass through test chamber 38 but passes through samples control valve 40 and back to the bore hole 11 through conduit 41. By this arrangement test chamber 38 is not overloaded and there is more certainty of obtaining a sample representative of the fluid undergoing test in chamber 38 with the same fluid also simultaneously flowing to and through the sample control valve 40.

When the test results transmitted to the surface indicate that the formation fluids being withdrawn are suitable for collection, the pump 27 is stopped and the sample control valve 40 is electrically actuated to a position to discontinue flow of fluid to the bore hole through conduit 41 and to instead convey fluid to the first sample chamber indicated at 42. The chambers need not be evacuated or vented to the bore hole 11 as downhole pressures are so large that any air brought down from the surface in the tool 10 will be so compressed as to occupy but a small fraction of chamber volume. When sample chamber 42 has been filled the pump 27 is stopped and the rotary control valve is actuated to packer deflate position opening the valve port indicated at 33 to the bore hole and permitting the packers 20 to deflate. Suitable valved connections (not shown) are provided through the side of tool 10 for withdrawal of the samples from the chambers 42.

Following deflation of the packers 20 the tool 10 is again free to be moved to other preselected levels in the bore hole 11, and the above described steps can be repeated. Alternatively if it is decided at the surface that the formation fluid passing through test chamber 38 will not produce a sample desired for retention and transport to the surface no sample is collected at that level in the bore hole; and the pump 27 can be stopped, the packers 20 deflated and the tool moved to another level.

In the preferred embodiment of the logging-sampling tool 10 of this invention, the capability of determining formation fluid pressure is provided by means of a pressure sensor 45 connected to the fluid conduit downstream of the pump 27. This sensor 45 which preferably contains a transducer monitors formation fluid pressure during periods when the pump 27 is not operating and sends appropriate signals through the wireline 21 to the surface.

As will be apparent to those skilled in the art any of the conventional logging techniques, such as gamma ray, neutron, induction, sonic, etc., adaptable for wireline logging, can be practiced in conjunction with the method and apparatus of this invention by incorporating appropriate conventional sensing and transmission apparatus within the tool 10. Information from such ancillary apparatus can be of considerable aid in initially placing the tool in the bore hole for the testing and sampling procedure of this invention. Incidentally the words "bore hole" have been used herein and in the claims in their generic sense and are meant to include any cased or uncased generally cylindrical opening, sealable by means of a packer and whether intended for exploration or production purposes. Thus the expression includes drill hole, well bore and other equivalent terms.

In the foregoing detailed description, the circuitry for obtaining signals from the various sensing devices and transmitting them to the surface and for transmitting electrical commands from the surface to the tool have not been included as these techniques are well known to those skilled in the art and a multitude of different arrangements are available and may be used in the practice of this invention.

Various changes and/or modifications such as will present themselves to those familiar with the art may be made in the method and apparatus described herein without departing from the spirit of this invention whose scope is commensurate with the following claims:

What is claimed is:

1. A method for obtaining formation fluid samples from a borehole, comprising:

(a) lowering a tool suspended by a wireline into the borehole to a preselected level;

(b) utilizing a pair of packers carried by the tool to isolate an interval of the borehole by inflating the packers to expand them into sealing contact with the borehole;

(c) withdrawing fluid from the isolated interval and meauring its resistivity in a first test chamber within the tool;

(d) when the resistivity measurement becomes constant, indicating that formation fluid uncontaminated by drilling mud components is being withdrawn into the tool, directing the withdrawn fluid into a second test chamber and measuring therein selected physical properties of the fluid;

(e) determining from the selected property measurements whether it is desired to retain a sample and, if the determination is positive, pumping the fluid to a sample collection chamber associated with the tool;

(f) deflating the pair of packers to free the tool for vertical movement; and (g) retracting the wireline to return the tool and the collected sample to the surface.

2. An apparatus operable on a wireline logging cable for sampling and testing formation fluids, comprising:

(a) a pair of inflatable packers for isolating an interval of the borehole when inflated;

(b) an electrically-driven hydraulic pump for withdrawing fluids from a space between the packers, and a conduit interconnecting the outlet of the pump to the packers;

(c) a resistivity test chamber through which the withdrawn fluids are conducted;

(d) a fluid property test chamber in communication with the outlet of the pump and adapted to measure selected properties of the withdrawn fluid;

(e) a sample collection chamber in communication with the outlet of the pump; and (f) valve means for controlling the flow of the withdrawn fluid to inflate the packers and to direct the fluid to the fluid property test chamber and the sample collection chamber.

3. The apparatus of claim 2 wherein the fluid property test chamber tests acidity, redox potential and temperature.

4. The apparatus of claim 2 and including a plurality of sample collection chambers.

5. A method for obtaining formation fluid samples from a borehole, comprising:

(a) lowering a tool into the borehole;

(b) utilizing means associated with the tool to isolate a portion of the borehole;

(c) withdrawing fluid from the isolated portion of the borehole and measuring a first physical property thereof within the tool;

(d) when the first measured physical property indication is constant, directing the withdrawn fluid into a test chamber and measuring therein a second physical property of the fluid;

(e) determining from the second physical property measurements whether it is desired to retain a sample and, if the determination is positive, transferring the fluid to a sample collection chamber within the tool, if the determination if negative, rejecting the fluid; and (f) retracting the tool and the collected fluid sample to the surface.

6. A method for obtaining formation fluid samples from a borehole, comprising:

(a) lowering a tool into the borehole;

(b) utilizing a pair of vertically spaced apart sealing means associated with the tool for isolating a vertical interval of the borehole;

(c) withdrawing fluid from the isolated vertical interval of the borehole and measuring a physical property thereof in a test chamber within the tool;

(d) determining from the physical property measurement whether it is desired to retain a fluid sample and, if the determination is positive, pumping the fluid from the isolated vertical interval of the borehole to one of a plurality of sample collection chambers within the tool; if the determination is negative, pumping the fluid directly to the borehole at a point outside the isolated vertical interval;

(e) deactivating the sealing means to free the tool for vertical movement; and (f) retracting the tool and the collected fluid sample to the surface.

7. A method for obtaining formation fluid samples from a borehole, comprising:

(a) lowering a tool into the borehole to a selected level;

(b) utilizing means associated with the tool to isolate a portion of the borehole by expanding the means into sealing contact with the borehole;

(c) withdrawing fluid from the isolated portion of the borehole and measuring its resistivity in a resistivity test chamber;

(d) when the resistivity measurement becomes constant, directing the withdrawn fluid into a second test chamber for measuring therein physical properties of the fluid;

(e) determining from the physical property measurement whether it is desired to retain a fluid sample and, if the determination is positive, pumping the fluid to a sample collection chamber associated with the tool; and if the determination is negative, returning the fluid directly to the borehole at a location outside the isolated portion; and (f) freeing the tool for vertical movement and moving the tool to the surface.

8. A method of collecting a fluid sample from a subterranean formation penetrated by a borehole, comprising:

(a) utilizing a pair of vertically-spaced apart sealing means to isolate a vertical interval of the borehole between the sealing means;

(b) withdrawing fluid from the isolated vertical interval;

(c) testing within the borehole a physical property of the withdrawn fluid;

(d) if the test results are positive, collecting in a sample container within the borehole a sample of the withdrawn fluid from the isolated vertical interval, and if test results are negative, discharging the withdrawn fluid directly into the borehole outside of the isolated vertical interval; and (e) transporting the sample container to the surface of the earth.

9. The method of claim 8 including the step of determining the pressure in the isolated vertical interval when fluid is not being withdrawn.

10. An apparatus for sampling and testing borehole formation fluids, the apparatus comprising a downhole tool adapted to be lowered into a borehole, the tool further comprising:

(a) sealing means for isolating an interval of the borehole when actuated;

(b) pump means for withdrawing fluids from the isolated interval of the borehole and conduit means connecting the outlet of the pump means to the sealing means whereby actuation thereof can be accomplished to isolate the interval of the borehole;

(c) a physical property test chamber through which the withdrawn fluids are conducted;

(d) a second test chamber in communication with the outlet of the pump means and adapted to measure properties of the withdrawn fluids;

(e) a sample collection chamber adapted to be in communication with the outlet of the pump means; and (f) valve means for controlling the flow of the withdrawn fluids to actuate the sealing means and to direct the fluids to the second test chamber and the sample collection chamber.

11. The apparatus of claim 10 wherein the second chamber is adapted to test fluid acidity.

12. The apparatus of claim 10 and including a plurality of sample collection chambers.

13. An apparatus for using a borehole extending from the surface of the earth to a subterranean location, comprising:

(a) vertically spaced sealing means for isolating a vertical interval of the borehole between the sealing means;

(b) withdrawing means for withdrawing fluid from the isolated vertical interval;

(c) testing means for testing a physical property of the withdrawn fluids;

(d) means for collecting at least one sample of the withdrawn fluid; and (e) means for discharging fluid not collected directly to the borehole exterior of the isolated vertical interval.

* * * * *